United States Patent [19]

Schaffrin

[11] 4,190,273

[45] Feb. 26, 1980

[54] CABINET LOCK ASSEMBLY

[75] Inventor: Carl E. Schaffrin, St. Charles, Mo.

[73] Assignee: The United States of America as represented by the Secretary of the Air Force, Washington, D.C.

[21] Appl. No.: 913,188

[22] Filed: Jun. 6, 1978

[51] Int. Cl.[2] ..... E05C 19/18

[52] U.S. Cl. ..... 292/288; 70/14; 70/80; 70/DIG. 65; 292/295

[58] Field of Search ..... 292/288–295, 292/148; 70/14, 2, 80, DIG. 64, DIG. 65

[56] References Cited

U.S. PATENT DOCUMENTS

| | | | |
|---|---|---|---|
| 884,141 | 4/1908 | Fay | 292/288 |
| 2,536,941 | 1/1951 | Jones | 292/288 |
| 2,638,371 | 5/1953 | Kennedy | 292/288 |
| 3,181,319 | 5/1965 | Hudon | 292/289 X |
| 3,280,606 | 10/1966 | Howard et al. | 292/259 |
| 3,752,518 | 8/1973 | Cannell | 292/259 X |

*Primary Examiner*—William E. Lyddane

*Attorney, Agent, or Firm*—Joseph E. Rusz; James S. Shannon; Casimer K. Salys

[57] ABSTRACT

A locking apparatus for use with a cabinet or other structure having double doors separated by a jamb at the point of closure. Two brackets are mounted on either side of the jamb, extending beyond the exterior surface of the cabinet sufficiently to install a locking device. The locking device obstructs the opening of the cabinet doors. The apparatus is structured such that it can be installed and removed from the cabinet without modifications to the cabinet or the need for special tools.

1 Claim, 3 Drawing Figures

CABINET LOCK ASSEMBLY

RIGHTS OF THE GOVERNMENT

The invention described herein may be manufactured and used by or for the Government of the United States for all governmental purposes without the payment of any royalty.

BACKGROUND OF THE INVENTION (1) Field of the Invention

This invention relates to locking apparatus for cabinets or other structures having a set of double doors closing onto a common jamb between them. More particularly the invention is directed to a single three piece locking apparatus for such applications wherein the pieces are configured for easy mounting and removal without structural modifications or the need for tools.

(2) Description of the Prior Art

Though a variety of devices for locking doors are known in the relevant art, most of their configurations suffer from complexity or structural characteristics necessitating installation during original manufacture. Those that are designed for use with a cabinet or other structure not having a permanently installed locking apparatus are incapable of handling double doors with an intermediate jamb.

In the context of storage cabinets, the use of double door configurations for holding and transporting packages is a representative application. Often such cabinets are not manufactured to be lockable; nevertheless, package inventory must be maintained by a sealing procedure. During transit such seals are frequently broken, necessitating the expenditure of time to repeat the inventory and inspection of the cabinet contents. Therefore, an easily installable seal or locking device would be of distinct benefit.

U.S. Pat. Nos. 1,368,711 and 3,181,319 represent the state of the prior art known to applicant. These patents do not teach either the combination or the distinct and beneficial structure claimed by the applicant.

SUMMARY OF THE INVENTION

The invention is a locking apparatus for use with double doors closing onto a common jamb. Two brackets hook over the inner edges of and extend outwardly between the doors and the jamb beyond the outer surface of the closed doors. A locking bar extending through holes in the brackets obstructs the opening of either door. The bar is retained in place by a suitable retaining device which passes through a hole in the bar between the brackets.

DESCRIPTION OF THE PREFERRED EMBODIMENT

Figure 1:
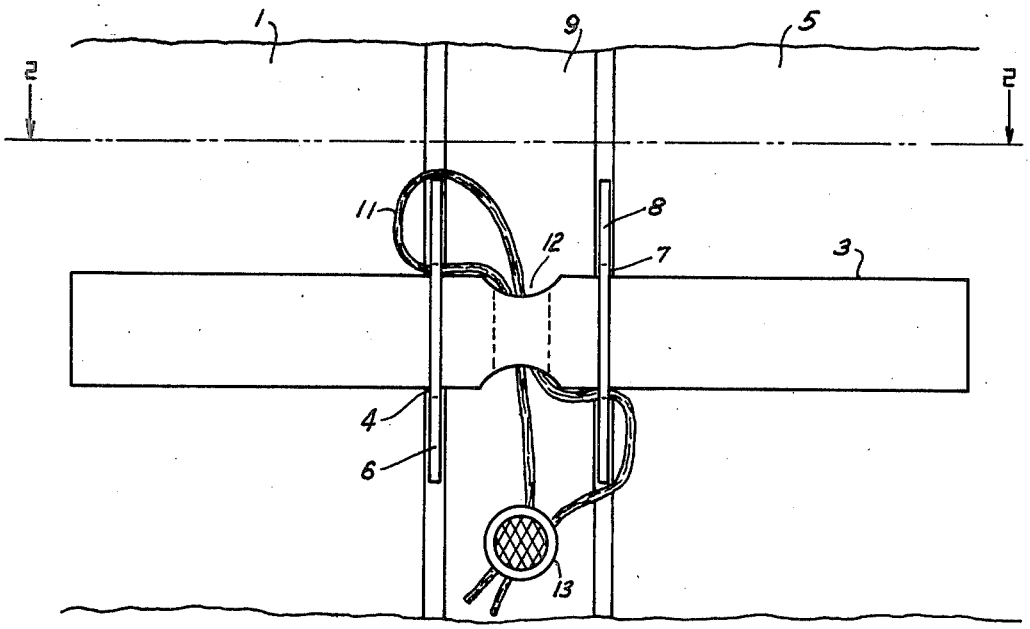
FIG. 1 is a front elevation of the cabinet lock apparatus installed on a cabinet and then sealed in place.

Appearing in FIG. 1 is one embodiment of the invention viewed from the exterior of the storage cabinet onto which it is mounted. The use of the wired seal arrangement depicted in FIG. 1 represents one application for which this apparatus is distinctly suited.

As shown, left cabinet door 1 and right cabinet door 5 are prevented from opening by bar 3 which passes through hole 4 in left bracket 6 and hole 7 in right bracket 8. The brackets themselves are attached to door jamb 9 in a manner to be fully described hereinafter.

Figure 3:
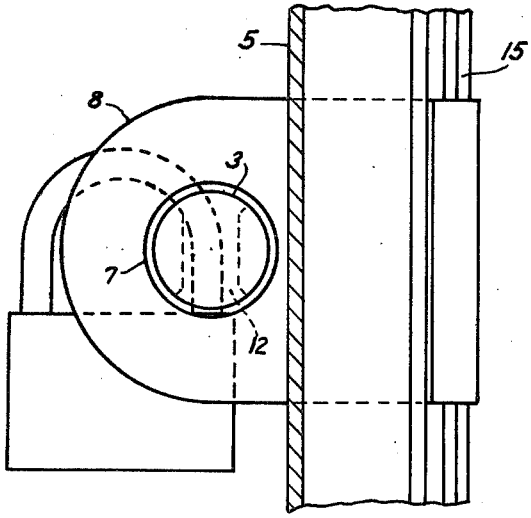
FIG. 3 is a side elevation taken at vertical plane 3—3 of FIG. 2.

The seal installed on the locking apparatus is conventional, consisting of wire segment 11 wrapped through holes 4 and 7 in the brackets and hole 12 in bar 3. The opposite ends of the wire are terminated by closure 13. It is readily apparent that a conventional lock inserted through hole 12 in rod 3, as shown in FIG. 3, would perform the same function as the wire described above.

Figure 2:
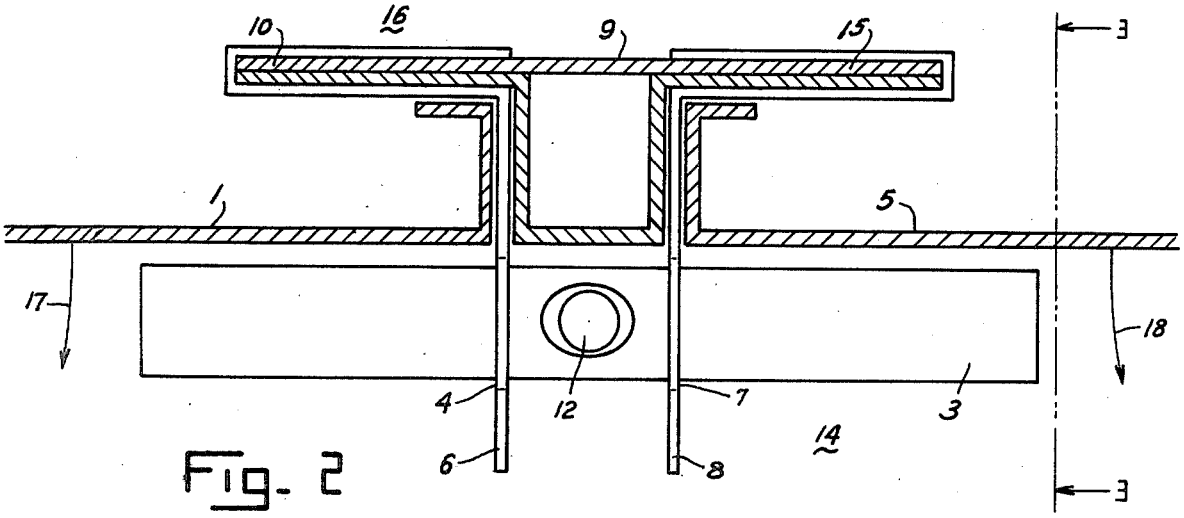
FIG. 2 is a cross-sectional view taken at the horizontal plane 2—2 of FIG. 1.

The same apparatus, but without the seal, is shown in cross-sectional form in FIG. 2. Cabinet exterior 14 and interior 16 are separated by door jamb 9 and a pair of doors, 1 and 5, abutting on jamb 9. Left door 1 rotates about a hinge (not shown) such that the segment appearing in the figure travels in an arc as shown by arrow 17. Similarly, right door 5 follows arc 18.

Left bracket 6 and right bracket 8 are folded back upon themselves at their interior edges to form a snug slide fit over lateral extensions 10 and 15 of jamb 9. Structurally these extensions perform the function of door abutments. Once the two brackets have been installed, rod 3 is inserted through holes 4 and 7 until hole 12 in rod 3 is located between brackets 6 and 8. Hole 12 is then retained between brackets 6 and 8 in any one of many conventional means, such as a lock or a wire seal.

It is readily apparent that the length of rod 3 must be sufficient to prevent doors 1 or 5 from being opened when the locking means inserted through hole 12 is moved to either its left or right extreme of travel between brackets 6 and 8.

The apparatus described above is especially suited for use with cabinets of the type described since the individual parts are inexpensive to manufacture, they are easy to install, they are easy to remove, and they provide the user significant latitude as to the locking device to be used in different applications.

I claim:

1. An apparatus for locking a pair of doors which open outward and abut when closed onto two lateral extensions of a common jamb, comprising:

a. a first bracket, folded back against itself at its interior edge so as to be slidably mounted on the first of the lateral extensions of the jamb, said bracket including a laterally extending segment which when the bracket is mounted in the manner described extends outwardly from the space between one of the doors and the jamb beyond the door, said bracket having passage therethrough in the segment extending beyond the door;

b. a second bracket, substantially identical to said first bracket, mounted on the second lateral extension of the door jamb in mirrored relationship to said first bracket so as to align the passages in the outwardly extending segments in confronting relationship to each other;

c. a rod-like member capable of being inserted through both bracket passages, and when so inserted extends laterally either side of said jamb distances sufficient to obstruct the opening of both doors;

d. a passage through said rod-like member, substantially transverse to its longitudinal axis, said transverse passage being medial of the brackets when said member is inserted therethrough; and e. a retention means for limiting the lateral travel of the rod to prevent removal thereof, said means capable of being inserted through the transverse passage in said rod-like member when the passage is medial of said brackets.

* * * * *